US009841037B2

(12) United States Patent
Tho et al.

(10) Patent No.: US 9,841,037 B2
(45) Date of Patent: Dec. 12, 2017

(54) CONSTRUCTION EQUIPMENT HYDRAULIC SYSTEM AND CONTROL METHOD THEREFOR

(71) Applicant: Doosan Infracore Co., Ltd., Incheon (KR)

(72) Inventors: Yong Ho Tho, Seoul (KR); Woo Yong Jung, Seoul (KR); Yong Lak Cho, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 138 days.

(21) Appl. No.: 14/777,823

(22) PCT Filed: Mar. 19, 2014

(86) PCT No.: PCT/KR2014/002301
§ 371 (c)(1),
(2) Date: Sep. 17, 2015

(87) PCT Pub. No.: WO2014/148808
PCT Pub. Date: Sep. 25, 2014

(65) Prior Publication Data

US 2016/0290370 A1 Oct. 6, 2016

(30) Foreign Application Priority Data

Mar. 19, 2013 (KR) ..... 10-2013-0029020

(51) Int. Cl.
*F15B 13/06* (2006.01)
*E02F 9/22* (2006.01)
*F15B 11/17* (2006.01)

(52) U.S. Cl.
CPC ..... *F15B 13/06* (2013.01); *E02F 9/2228* (2013.01); *E02F 9/2235* (2013.01); (Continued)

(58) Field of Classification Search
CPC ..... E02F 9/2228; E02F 9/2235; E02F 9/2267; E02F 9/2292; E02F 9/2271; E02F 9/2296; (Continued)

(56) References Cited

U.S. PATENT DOCUMENTS 5,176,504 A 1/1993 Moriya et al.
5,829,252 A * 11/1998 Hirata ..... E02F 9/2242 60/421
9,429,152 B2 * 8/2016 Yamaji ..... F04B 49/22

FOREIGN PATENT DOCUMENTS

EP 0945619 9/1999
EP 1571339 9/2005
(Continued)

OTHER PUBLICATIONS

Supplementary Partial European Search Report issued in related European Patent Application No. EP14770438 dated Nov. 25, 2016.
(Continued)

*Primary Examiner* — Logan Kraft
(74) *Attorney, Agent, or Firm* — K&L Gates LLP

(57) ABSTRACT

Disclosed are a hydraulic system for construction equipment and a method of controlling the same, and the hydraulic system for construction equipment includes: a plurality of pressure control-type hydraulic pumps driven by an engine provided in construction equipment; an actuator driven by working oil discharged from the hydraulic pump; a closed center-type main control valve provided between the hydraulic pump and the actuator, and bypassing a virtual flow rate; and a controller configured to control the hydraulic pump by receiving the bypassed virtual flow rate from the main control valve.

18 Claims, 11 Drawing Sheets

(52) U.S. Cl.
CPC ..... *E02F 9/2267* (2013.01); *E02F 9/2271* (2013.01); *E02F 9/2292* (2013.01); *E02F 9/2296* (2013.01); *F15B 11/17* (2013.01); *F15B 2211/20523* (2013.01); *F15B 2211/20553* (2013.01); *F15B 2211/20576* (2013.01); *F15B 2211/25* (2013.01); *F15B 2211/2656* (2013.01); *F15B 2211/3111* (2013.01); *F15B 2211/6346* (2013.01); *F15B 2211/6652* (2013.01)

(58) Field of Classification Search
CPC F15B 11/17; F15B 13/06; F15B 2211/20576; F15B 2211/25; F15B 2211/2656; F15B 2211/20553; F15B 2211/3111; F15B 2211/6346; F15B 2211/6652; F15B 2211/20523
See application file for complete search history.

(56) References Cited

FOREIGN PATENT DOCUMENTS

| | | |
|---|---|---|
| JP | 200304001 | 1/2003 |
| JP | 3664733 | 6/2005 |
| KR | 20040080177 | 9/2004 |
| KR | 10-2007-0106713 | 11/2007 |
| KR | 10-2011-0054739 | 5/2011 |
| WO | 2012057241 | 5/2012 |

OTHER PUBLICATIONS

International Search Report for International Patent Application PCT/KR2014/002301 dated Jun. 18, 2014. 4 pages.

* cited by examiner

FIXED DISTRIBUTION OF
ENGINE HORSEPOWER
ps1:ps2 = 50%:50%

CONSTRUCTION EQUIPMENT HYDRAULIC SYSTEM AND CONTROL METHOD THEREFOR

CROSS REFERENCE TO RELATED APPLICATIONS

The present application is a National Stage of International Application No. PCT/KR2014/002301, filed on Mar. 19, 2014, which claims priority to Korean Patent Application No. 10-2013-0029020, filed on Mar. 19, 2013, the entire contents of each of which are being incorporated herein by reference.

FIELD OF THE DISCLOSURE

The present disclosure relates to a hydraulic system for construction equipment and a control method thereof, and more particularly, to hydraulic system for construction equipment, which implements a free load feeling when construction equipment is operated, and separately controls a plurality of hydraulic pumps according to an operation mode of construction equipment, and a control method thereof.

BACKGROUND OF THE DISCLOSURE

In general, construction equipment includes a hydraulic system, and the hydraulic system receives power from an engine. The hydraulic system includes a hydraulic pump, a main control valve, an actuator, an operating unit, and the like.

FIG. 1 is a hydraulic circuit diagram illustrating a hydraulic system for construction equipment in the related art, and the hydraulic system for construction equipment includes a hydraulic pump 1, an actuator 2 driven by working oil discharged from the hydraulic pump 1, a spool 3 configuring a main control valve (not illustrated) provided between the hydraulic pump 1 and the actuator, an open center flow path 4 bypassing, that is, bleeding off, working oil discharged from the hydraulic pump 1 when the spool 3 is in a neutral state, a flow rate controller 5 receiving a negative flow control (NFC) pressure Pn detected by the open center flow path 4 and controlling a swash plate angle of the hydraulic pump 1 in order to adjust a flow rate of the hydraulic pump 1, and the like.

Particularly, when a driver operates an operating unit, such as a joystick, in order to drive the actuator 2, the spool 3 moves, so that the open center flow path 4 is decreased. Accordingly, a swash plate angle is adjusted so that the NFC pressure Pn is decreased, and a flow rate of the hydraulic pump 1 is increased. That is, the hydraulic system for construction equipment is controlled so that an input signal Pn of the hydraulic pump 1 is inversely proportional to an output signal (flow rate) of the hydraulic pump 1.

According to the hydraulic system for construction equipment, there is a problem in that working oil bypasses the open center flow path 4 when the hydraulic system for construction equipment stands by, so that a flow rate is lost, and pressure is lost according to a design of the spool 3, thereby degrading efficiency.

In the meantime, the hydraulic pump in the hydraulic system for construction equipment known in the related art includes a first pump and a second pump, which are flow rate control types, and an auxiliary pump. The first pump and the second pump provide working oil to the actuator performing an operation, and the auxiliary pump provides pilot working oil to an additional hydraulic device or a pressure receiving portion of the spool of a valve unit.

A plurality of valve units for distributing working oil to each actuator is provided inside the main control valve. Spools are provided in the valve units, respectively, and the valve unit is opened/closed according to a movement of the spool to control a flow direction of working oil to be a forward direction or a reverse direction. A movement displacement of the spool may be varied by the pilot working oil.

Spools of operating units, which the first pump and second pump take charge in, are determined, for example, the first pump may take in charge of a spool for a first speed of an arm, a spool for a second speed of a boom, a swing spool, an option spool, and a right travelling spool, and the second pump may take in charge of a spool for a second speed of the arm, a spool for a first speed of the boom, a bucket spool, and a left travelling spool.

The various spools may be complexly operated in order to perform an operation desired by an operator. For example, when excavating and loading operations are performed, soil is drawn up by operations of going down a boom, crowding an arm, and crowding a bucket, a boom goes up and an upper body swings, and then the soil is moved and drawn out by operations of dumping the arm and dumping the bucket.

Each actuator of the operating unit performs a series of operations, and a relatively small load is applied to the swing of the upper body, compared to a load applied to the boom up and the arm crowd.

The hydraulic system for construction equipment known in the related art equally distributes power of an engine to the first pump and the second pump. That is, when it is assumed that power of the engine is 100%, 50% of the power of the engine is distributed to the first pump and the second pump each, so that flow rates of the pumps are controlled.

As described above, a load is differently applied to a specific operation of a specific actuator among the various actuators. That is, a heavy load may be applied to the first pump or a light load may be applied to the second pump. In this case, it is recognized that the second pump relatively has a pump power margin.

In the hydraulic system for construction equipment known in the related art, the flow rate of the first pump, to which the heavy load is applied as described above, is controlled so that power of the first pump is increased, and the flow rate of the second pump, to which the light load is applied, is controlled so that power of the second pump is decreased.

The aforementioned control of the pump will be additionally described. The first pump and the second pump detect pump pressures thereof, and a swash plate angle of a corresponding pump is adjusted according to a size of a pump pressure of a counterpart pump. For example, when the pump pressure of the counterpart pump is high, the swash plate angle of the corresponding pump is controlled so that a swept volume of the corresponding pump is decreased, and when a pump pressure of the corresponding pump is high, a swash plate angle of the counterpart pump is controlled so that a swept volume of the counterpart pump is increased. Here, the swept volume (cc/rev) means a flow quantity discharged per unit revolution of the pump.

The control of the hydraulic system known in the related art has the problems below.

In order for the first pump and the second pump to serve as a corresponding pump controlling a counterpart pump pressure, working oil passes hydraulic lines and various valves, and in this process, pressure of the working oil is lost. Further, the pump power having a margin means that some of the power generated by the engine is not used and is wasted.

In the meantime, the engine combusts fuel to generate power, so that as described above, fuel is wasted by the amount of non-used power of the engine.

On the other hand, as described above, the first pump and the second pump according to the hydraulic system known in the related art limit horsepower with an average of the pressures, so that that is a problem in that the first pump and the second pump inevitably use horsepower control, in which a discharged flow rate is not considered, and it is impossible to use maximum horsepower generable by the pump in a specific operation form.

Further, it is set that engine horsepower is allocated to the first pump and the second pump according to the hydraulic system for construction equipment known in the related art at the same ratio, so that there is a problem in that it is impossible to differently set a distribution ratio of the engine horsepower even though a load applied for each operation mode or a load mode is different.

SUMMARY

In order to solve the aforementioned problems, the present disclosure provides a hydraulic system for construction equipment, which includes a closed center-type main control valve and a pressure control-type hydraulic pump to prevent a flow rate and pressure from being lost and implement a free load feeling, and a method of controlling a hydraulic system for construction equipment, in which a distribution ratio of horsepower of an engine is set according to an operation mode or a load and the horsepower of the engine is distributed to a first pump and a second pump according to the distribution ratio, so that the horsepower of the engine provided to the first pump and the second pump from the engine is completely used, thereby improving fuel efficiency.

A technical object to be achieved in the present disclosure is not limited to the aforementioned technical objects, and other not-mentioned technical objects will be obviously understood from the description below by those skilled in the technical field to which the present disclosure pertains.

In order to solve the technical problems of the present disclosure, an exemplary embodiment of the present disclosure provides a hydraulic system for construction equipment, including: a plurality of pressure control-type hydraulic pumps driven by an engine provided in construction equipment; an actuator driven by working oil discharged from the hydraulic pump; a closed center-type main control valve provided between the hydraulic pump and the actuator, and bypassing a virtual flow rate; and a controller configured to control the hydraulic pump by receiving the bypassed virtual flow rate from the main control valve.

The hydraulic system may further include: a pressure sensor configured to detect pressures of a plurality of operating units provided in the construction equipment; an angle sensor configured to detect a swash plate angle of the hydraulic pump; and an electronic proportional pressure reducing (EPPR) valve provided between the hydraulic pump and the controller, in which the controller may receive the pressure of the operating unit and the swash plate angle of the hydraulic pump and output a current command according to the received pressure and swash plate angle to the EPPR valve, and the EPPR valve may control the swash plate angle in order to control the pressure of the hydraulic pump so as to be in proportion to the current command.

The controller may separately control the hydraulic pumps according to an operation mode of the construction equipment.

The controller may distribute a maximum horsepower value provided by the engine to each of the hydraulic pumps according to a distribution ratio preset for each operation mode of the construction equipment.

The hydraulic pumps may include a first pump and a second pump, and the controller may detect operation quantities from the plurality of operating units allocated to the first pump and the second pump, respectively, and sum the detected operation quantity for each of the first pump and the second pump, and allocate the pump having the larger summed operation quantity as the first pump.

The hydraulic pumps may include a first pump and a second pump, and the controller may allocate the pump having a larger load pressure between the first pump and the second pump as the first pump.

The hydraulic pumps include a first pump and a second pump, and the controller may include: a flow rate controller configured to compare flow rates of working oil discharged from the first pump and the second pump and flow rates of working oil required by a plurality of operating units provided in the construction equipment, and calculate a torque ratio of the first pump and the second pump; a power shift controller configured to calculate total of torque required by the hydraulic pump by receiving information from the operating unit, a load mode selecting unit, an engine speed setting unit, and an engine control unit (ECU); a horsepower distribution controller configured to calculate torque taken in charge by the first pump and the second pump according to the torque ratio calculated by the flow rate controller and the total of torque calculated by the power shift controller; and a pump controller configured to select the smallest value among a pressure command (Pi) generated by the flow rate controller, a pressure command (Pd) calculated by the horsepower distribution controller, and a maximum pump pressure value (Pmax) maximally applied to the operating unit and output the selected smallest value as a pressure command value of the first pump and the second pump.

The pressure command $P_i$ generated by the flow rate controller may be calculated by subtracting a bypass flow rate $Q_b$ and a flow rate $Q_a$ of working oil discharged from the first pump and the second pump from a required flow rate $Q_p$ calculated by detecting an operation pressure of the operating unit.

The pressure command $P_d$ calculated by the horsepower distribution controller may be calculated by determining a larger value between maximum power usable by the first pump calculated by dividing the total of torque calculated by the power shift controller by the torque ratio calculated by the flow rate controller and a value obtained by calculating power of the second pump by using an angle sensor and a pressure command of the second pump and subtracting the calculated power of the second pump from the total of torque as maximum power, and dividing the determined maximum power by an actual discharged flow rate $Q_p$.

In order to solve the technical problems of the present disclosure, another exemplary embodiment of the present disclosure provides a method of controlling a hydraulic system for construction equipment, which comprises a plurality of pressure control-type hydraulic pumps driven by an engine provided in construction equipment, the method including: a flow rate control operation for comparing flow rates of working oil discharged from the hydraulic pumps and flow rates of working oil required by a plurality of operating units provided in the construction equipment, and calculating a torque ratio of the hydraulic pump; a power shift control operation for calculating total of torque required by the hydraulic pump by receiving information from the operating unit, a load mode selecting unit, an engine speed setting unit, and an engine control unit (ECU); a horsepower distribution control operation for calculating torque taken in charge by each of the hydraulic pumps according to the torque ratio calculated in the flow rate control operation and the total of torque calculated in the power shift control operation; and a pump control operation for selecting the smallest value among a pressure command $P_i$ generated in the flow rate control operation, a pressure command $P_d$ calculated in the horsepower distribution control operation, and a maximum pump pressure value $P_{max}$, maximally applied to the operating unit and outputting the selected smallest value as a pressure command value of the hydraulic pump.

The pressure command $P_i$ generated in the flow rate control operation may be calculated by calculating an increase/decrease required flow rate dQ by subtracting a bypass flow rate $Q_b$ and a flow rate $Q_a$ of working oil discharged from the hydraulic pump from a required flow rate $Q_p$ calculated by detecting an operation pressure of the operating unit.

The pressure command (Pd) calculated in the horsepower distribution control operation may be calculated by determining a larger value between maximum power usable by any one of the hydraulic pumps calculated by dividing the total of torque calculated by the power shift control operation by the torque ratio calculated by the flow rate control operation and a value obtained by calculating power of the other of the hydraulic pumps by using an angle sensor and a pressure command of the other of the hydraulic pumps and subtracting the calculated power of the other of the hydraulic pumps from the total of torque as maximum power, and dividing the determined maximum power by an actual discharged flow rate $Q_p$.

The horsepower distribution control operation may include: an available horsepower calculation operation for calculating an available horsepower value by subtracting a current horsepower value from a counterpart pump from a maximum horsepower value provided by the engine for each of the hydraulic pumps; a maximum horsepower selection operation for selecting a larger horsepower value between a horsepower value calculated by the torque taken in charge by each of the hydraulic pumps according to the torque ratio calculated in the flow rate control operation and the total of torque calculated in the power shift control operation and the available horsepower value calculated in the available horsepower calculation operation as a final control horsepower value of a corresponding pump; and a pump pressure command generation operation for generating the final control horsepower value selected in the final horsepower selection operation as a pressure command $P_d$ controlling the corresponding pump.

The hydraulic pumps may be separately controlled according to an operation mode of the construction equipment.

A maximum horsepower value provided by the engine may be distributed to each of the hydraulic pumps according to a distribution ratio preset for each operation mode of the construction equipment.

The hydraulic pumps may include a first pump and a second pump, and the horsepower distribution control operation may include: selecting a larger horsepower value between a horsepower value calculated by the torque taken in charge by the first pump and a horsepower value calculated by subtracting a horsepower value calculated by the torque taken in charge by the second pump from a maximum horsepower value provided by the engine as a horsepower value of the first pump, and generating the selected horsepower value as the pressure command (Pd) controlling the first pump.

Operation quantities may be detected from the plurality of operating units allocated to the first pump and the second pump, respectively, and the detected operation quantity may be summed for each of the first pump and the second pump, and the pump having the larger summed operation quantity may be allocated as the first pump.

The pump having a larger load pressure between the first pump and the second pump may be allocated as the first pump.

According to the present disclosure, the hydraulic system for construction equipment includes the closed center-type main control valve and the pressure control-type hydraulic pump, so that it is possible to prevent a flow rate pressure from being lost and implement a free load feeling.

Further, according to the method of controlling the hydraulic system for construction equipment, in distributing horsepower of the engine to the first pump and the second pump, a distribution ratio is differently set according to an operation mode of the construction equipment and a load applied to the operating unit, so that it is possible to decrease a distribution ratio of the horsepower of the engine for a pump having a horsepower margin, and increase a distribution ratio of the horsepower of the engine for a pump, to which a relatively heavy load is applied.

Accordingly, it is possible to use all of the horsepower of the engine provided from the engine to the first pump and the second pump without waste, thereby improving fuel efficiency of the construction equipment.

BRIEF DESCRIPTION OF THE DRAWINGS

FIGS. 3 to 5 are schematic diagrams for describing an example of distributing horsepower of an engine to a first pump and a second pump in the hydraulic system for construction equipment according to the exemplary embodiment of the present disclosure.

DETAILED DESCRIPTION

Figure 1:
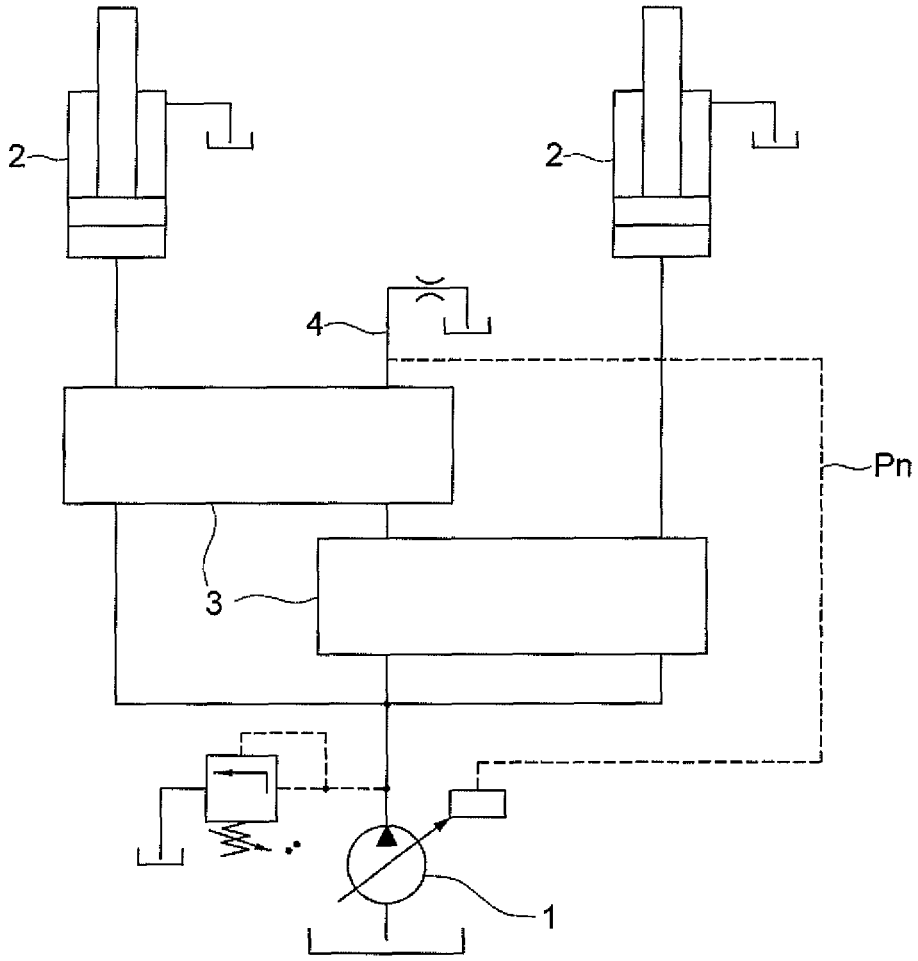
FIG. 1 (Prior Art)
FIG. 1 is a hydraulic circuit diagram illustrating a hydraulic system for construction equipment in the related art.

Hereinafter, an exemplary embodiment according to the present disclosure will be described in detail with reference to the accompanying drawings. In the process, a size or a shape of a constituent element illustrated in the drawing, and the like, may be exaggerated for clarity and ease of description. In addition, the terms, which are specially defined in consideration of configurations and operations of the present disclosure, may vary depending on the intention or usual practice of a user or an operator. These terms should be defined based on the content throughout the present specification. Further, the spirit of the present disclosure is not limited to the suggested exemplary embodiment, those skilled in the art who understand the spirit of the present disclosure may easily carry out other exemplary embodiments within the scope of the same spirit, and of course, the exemplary embodiments also belong to the scope of the present disclosure.

Figure 2:
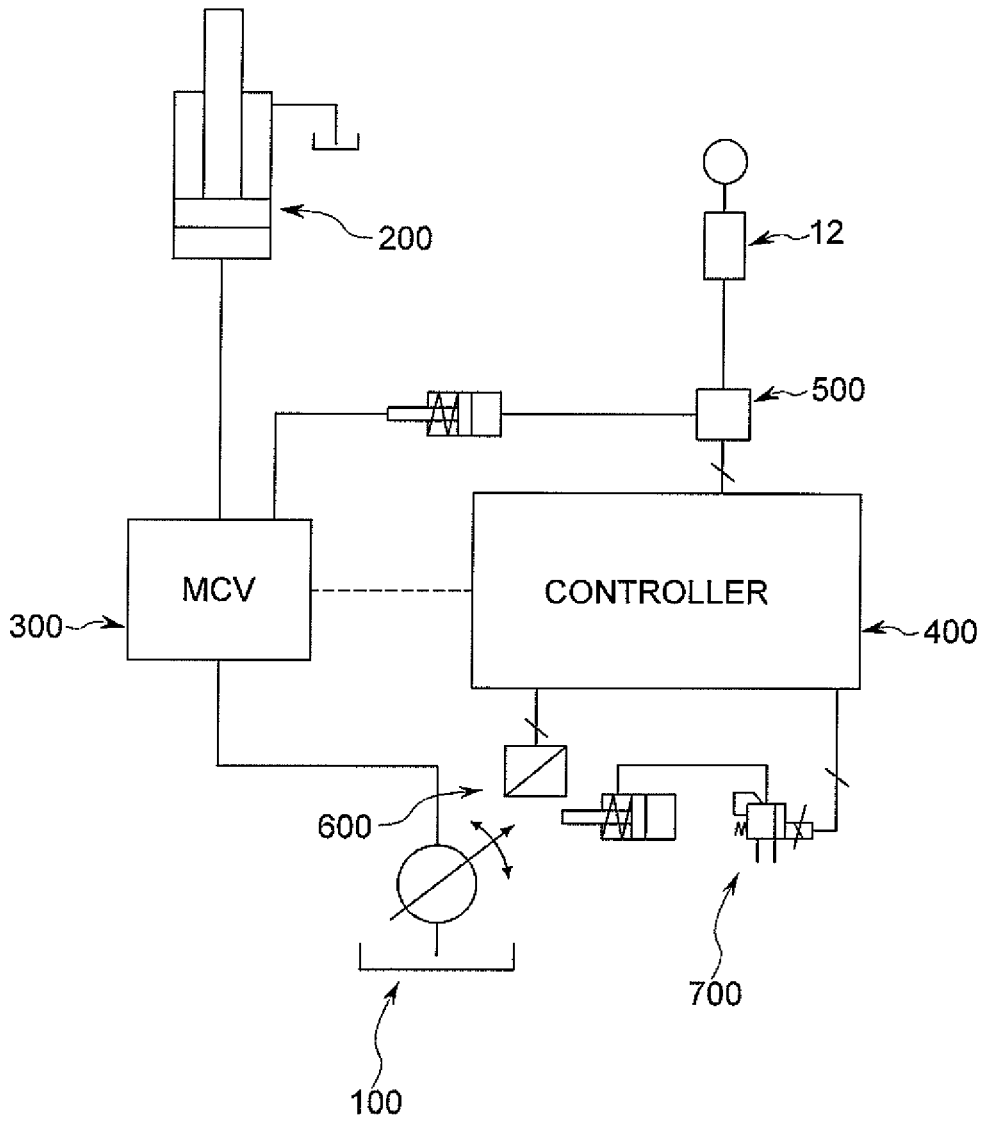
FIG. 2 is a hydraulic circuit diagram illustrating a hydraulic system for construction equipment according to an exemplary embodiment of the present disclosure.

FIG. 2 is a hydraulic circuit diagram illustrating a hydraulic system for construction equipment according to an exemplary embodiment of the present disclosure. A detailed configuration and function of the hydraulic system for construction equipment will be described with reference to FIG. 2.

FIG. 2 illustrates the hydraulic system of construction equipment, which includes a closed center-type main control valve and a pressure control-type hydraulic pump to control a flow rate and pressure and implement a free load feeling when operating the construction equipment, and the hydraulic system of construction equipment includes a hydraulic pump 100, an actuator 200, a main control valve 300, a controller 400, a pressure sensor 500, an angle sensor 600, and an electronic proportional pressure reducing valve (EPPR valve) 700.

The hydraulic pump 100 is driven by an engine (not illustrated) that is a driving source of construction equipment, and a plurality of hydraulic pumps is provided as pressure control-type electronic pumps. Accordingly, flexibility is excellent in a process of discharging working oil.

The actuator 200 is driven by working oil discharged from the hydraulic pump 100, and for example, may be provided as a hydraulic cylinder or a hydraulic motor.

The main control valve 300 is provided in a closed center type between the hydraulic pump 100 and the actuator 200, and enables the calculation of a virtual flow rate that is virtually bypassed when the actuator 200 is operated.

Particularly, the main control valve 300 is provided in the closed center type, so that a surplus flow rate and pressure are not lost, thereby improving fuel efficiency and the like of the construction equipment, and freely generating a load feeling similar as the load feeling generated in an open center-type main control valve using a virtual flow rate.

The controller 400 calculates the virtual flow rate to control the hydraulic pump 100.

That is, the controller 400 receives pressure of the operating unit 12 and a swash plate angle of the hydraulic pump 100 and outputs a current command according to the received pressure and swash plate angle to the EPPR valve 700, and the EPPR valve 700 controls the swash plate angle so as to control the pressure of the hydraulic pump 100 to be proportional to the current command.

Here, the pressure sensor 500 detects pressure applied to the plurality of operating units 12, that is, the joystick or the pedal, provided at the construction equipment and inputs the detected pressure into the controller 400, and the angle sensor 600 detects a swash plate angle of the hydraulic pump 100 and inputs the detected swash plate angle into the controller 400.

In the meantime, according to the exemplary embodiment of the present disclosure, in order to decrease a distribution ratio of engine horsepower at a pump, in which a horsepower margin is generated, among the plurality of pressure control-type hydraulic pumps 100 and to increase a distribution ratio of engine horsepower at a pump, to which a relatively heavy load is applied, the controller 400 separately controls the plurality of hydraulic pumps 100 according to an operation mode of the construction equipment.

That is, the controller 400 distributes a maximum horsepower value provided from the engine (not illustrated) to each of the hydraulic pumps 100 according to a distribution ratio predetermined for each operation mode of the construction equipment.

When the hydraulic pumps 100 include a first pump 110 and a second pump 120, examples of the operation modes of the construction equipment are represented in Table 1 below, and the distribution ratio according to each operation mode is a value suggested for helping understanding of the present disclosure and does not limit the scope of the present disclosure.

TABLE 1

| Operation | First pump (%) | Second pump (%) |
|---|---|---|
| Boom Up | 55 | 45 |
| Boom Down | 50 | 50 |
| Bucket Crowd | 50 | 50 |
| Bucket Dump | 50 | 50 |
| Arm Crowd | 40 | 60 |
| Arm Dump | 45 | 55 |
| Swing | 70 | 30 |
| Boom Up + Bucket | 55 | 45 |
| Boom Down + Bucket | 50 | 50 |
| Arm Crowd + Swing | 50 | 50 |
| Arm Dump + Swing | 30 | 70 |
| Boom Up + Arm | 50 | 50 |
| Boom Up + Swing | 70 | 30 |
| Bucket + Arm | 50 | 50 |
| Bucket + Swing | 70 | 30 |
| Three complex operations + Swing | 70 | 30 |

In this case, a specific hydraulic pump among the hydraulic pumps 100 may be allocated as the first pump 110 under two references.

First, the first pump 110 and the second pump 120 are allocated according to an operation quantity of the operating unit 12 of an operating device, such as a boom, an arm, and a bucket. Particularly, the controller 400 detects operation quantities from the plurality of operating units 12, that is, the joystick and the pedal, allocated to the first pump 110 and the second pump 120, respectively, sums the detected operation quantities for each first pump 110 and second pump 120, and allocates the pump having the larger summed operation quantity as the first pump 110.

Second, the first pump 110 and the second pump 120 are allocated according to a load applied during an operation. Particularly, the controller 400 allocates a pump having larger load pressure during an operation between the first pump 110 and the second pump 120 as the first pump 110.

In the meantime, according to the distribution ratio according to the operation mode of the construction equipment represented in Table 1, horsepower of the engine is distributed to the first pump 110 and the second pump 120 according to a distribution ratio of a corresponding operation mode, and a process of setting an initial flow rate of the first pump 110 and the second pump 120 will be described based on a case where the construction equipment simultaneously performs a boom-up operation and a swing operation as an example.

When the construction equipment simultaneously performs the boom-up operation and the swing operation, 70% of horsepower of the engine is distributed to the first pump 110, and 30% of horsepower of the engine is distributed to the second pump 120, as shown in Table 1.

When the second pump 120 does not use all of 30% of the horsepower of the engine in general, but uses about 20% of the horsepower of the engine as actual horsepower, it is possible to recognize an actual discharged quantity of working oil currently discharged from the second pump 120 by a load, that is, pressure, applied to an operating unit from the outside. That is, the actual discharged quantity of the second pump 120 is calculated by dividing horsepower by applied pressure (Q=horsepower/pressure), and a swash plate angle in this case is detected by the angle sensor 600.

In this case, 10% of the horsepower of the engine, that is the horsepower margin of the second pump 120, is added to 70% of the initially set horsepower of the engine, so that the first pump 110 may use 80% of the horsepower of the engine. Accordingly, when 80% of the horsepower of the engine is divided by the actual discharged flow rate of the first pump 110, it is possible to calculate discharged pressure of the first pump 110, and a pressure command according to the calculated discharged pressure is output to the controller 400.

As a result, the hydraulic system for construction equipment includes the closed center-type main control valve and the pressure control-type hydraulic pump, so that it is possible to prevent flow rate loss and pressure loss and implement a free load feeling.

Hereinafter, a process of distributing horsepower of the engine according to an operation mode of construction equipment by the hydraulic system for construction equipment will be described in detail with reference to FIGS. 3 to 14.

Figure 3:
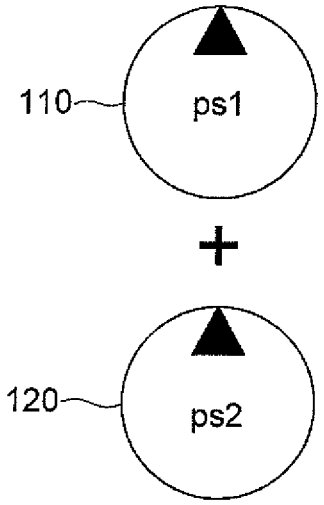
Figure 5:
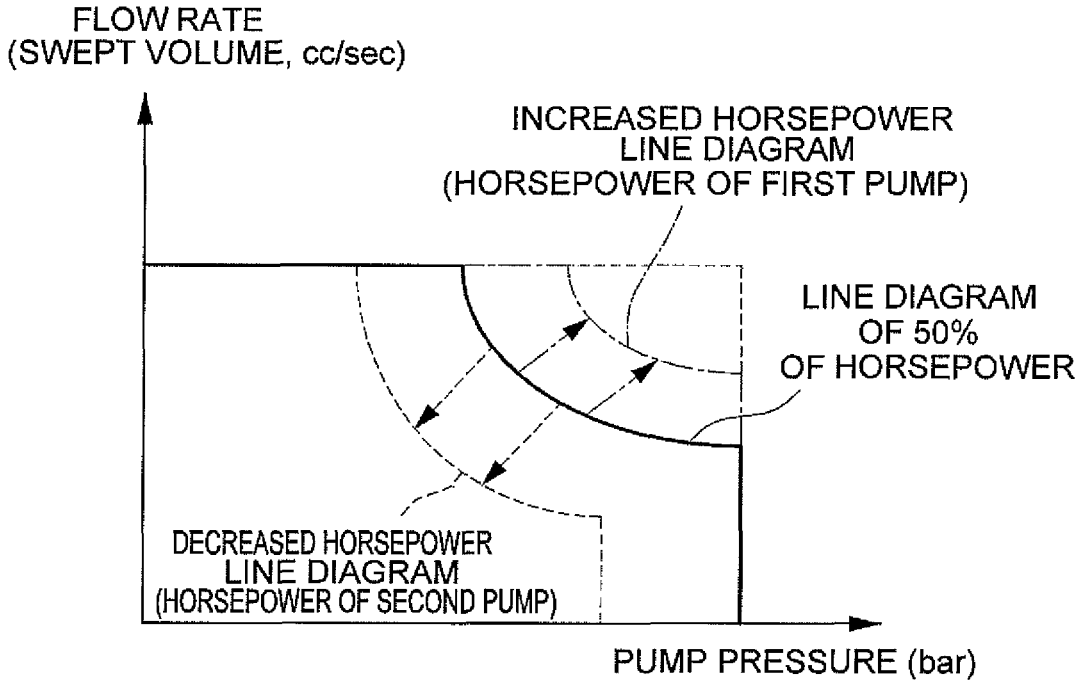

FIGS. 3 to 5 are schematic diagrams for describing an example of distributing horsepower of the engine to the first pump 110 and the second pump 120 in the hydraulic system for construction equipment according to the exemplary embodiment of the present disclosure, and referring to FIG. 3, it can be seen that first horsepower ps1 of the first pump 110 is the same as second horsepower ps2 of the second pump 20. The reason is that the horsepower of the engine is fixedly distributed by 50%:50%.

By contrast, referring to FIG. 4, it can be seen that the first horsepower ps1 of the first pump 110 and the second horsepower ps2 of the second pump 20 are variably distributed according to a distribution ratio x.

That is, as illustrated in FIG. 5, it can be seen that when the horsepower of the engine is distributed to the first pump 110 and the second pump 120 according to the distribution ratio x according to an operation mode of the construction equipment, for example, when the horsepower of the engine is weighted and distributed to the first pump 110 and relatively small horsepower of the engine is distributed to the second pump 120, the first horsepower ps1 of the first pump 110 is increased and the second horsepower ps2 of the second pump 120 is decreased based on a line diagram of 50% of the horsepower.

As a result, in distributing the horsepower of the engine to the first pump 110 and the second pump 120, a distribution ratio is differently set according to an operation mode of the construction equipment and a load applied to the operating unit, so that it is possible to decrease a distribution ratio of the horsepower of the engine for a pump having a horsepower margin, and increase a distribution ratio of the horsepower of the engine for a pump, to which a relatively heavy load is applied.

Accordingly, it is possible to use all of the horsepower of the engine provided from the engine to the first pump 110 and the second pump 120 without waste, thereby improving fuel efficiency of the construction equipment.

Figure 6:
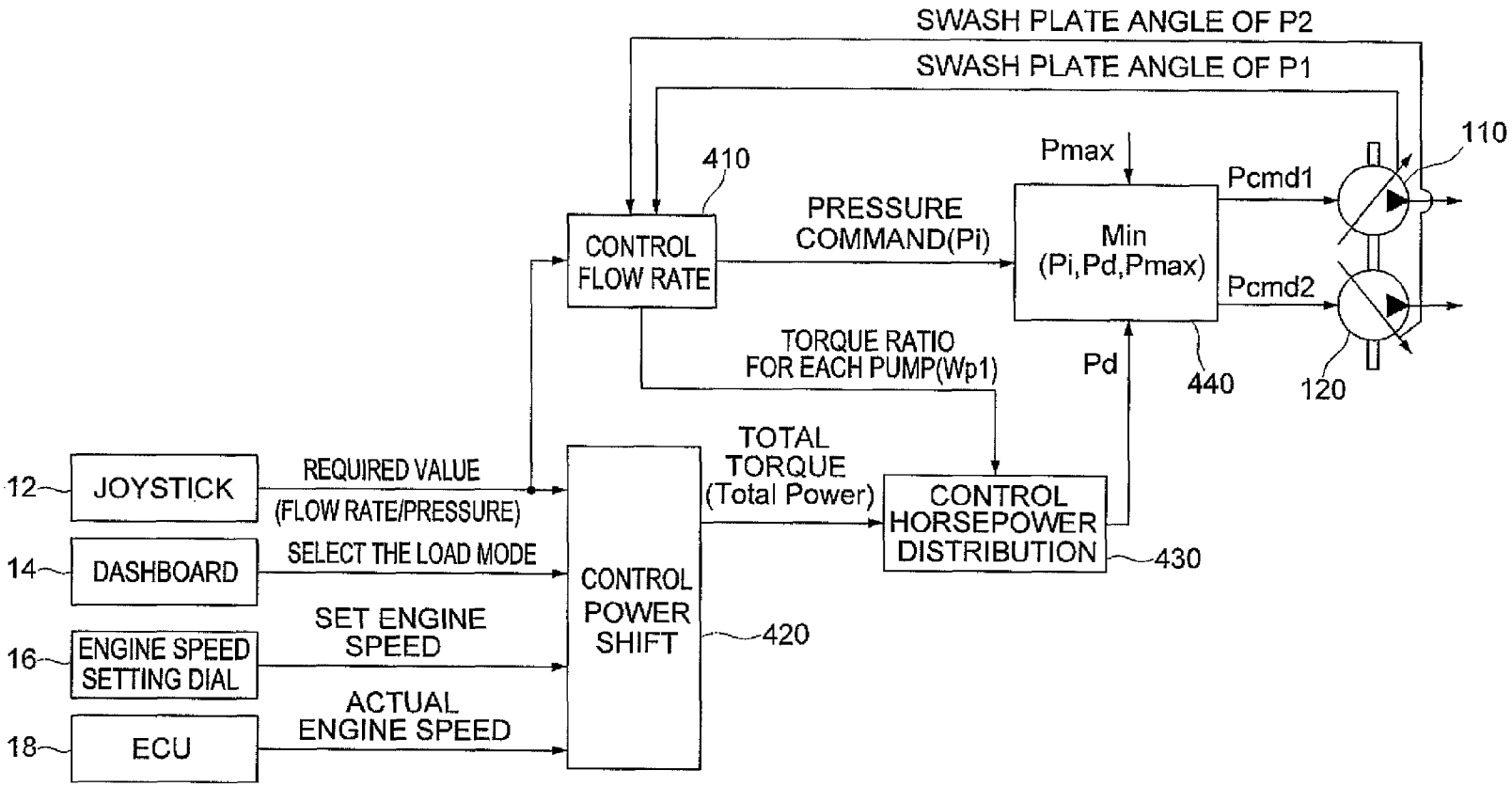
FIG. 6 is a configuration diagram illustrating the hydraulic system for construction equipment according to the exemplary embodiment of the present disclosure.
Figure 7:
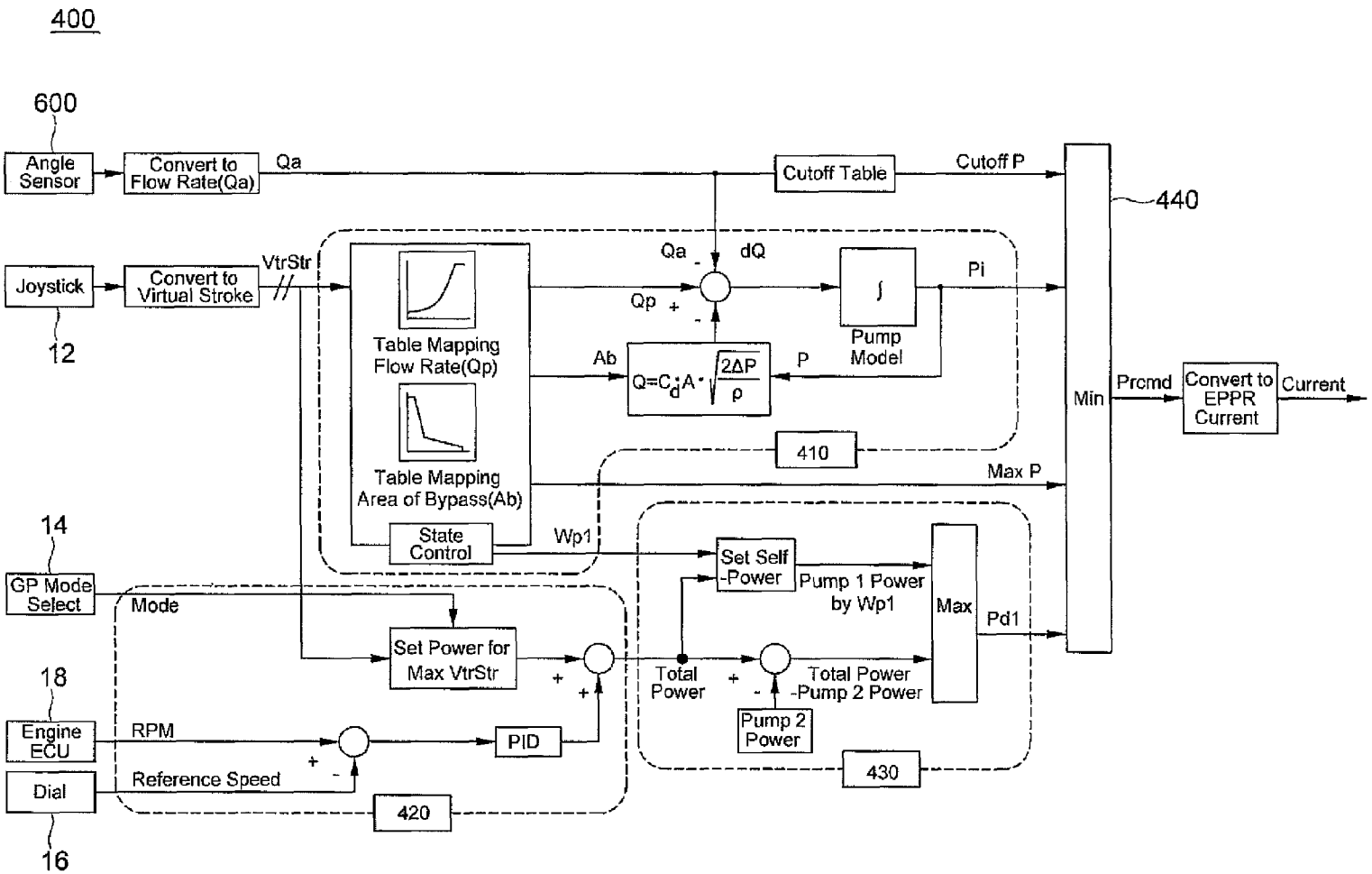
FIG. 7 is a configuration diagram illustrating a controller of the hydraulic system for construction equipment according to the exemplary embodiment of the present disclosure.
Figure 8:
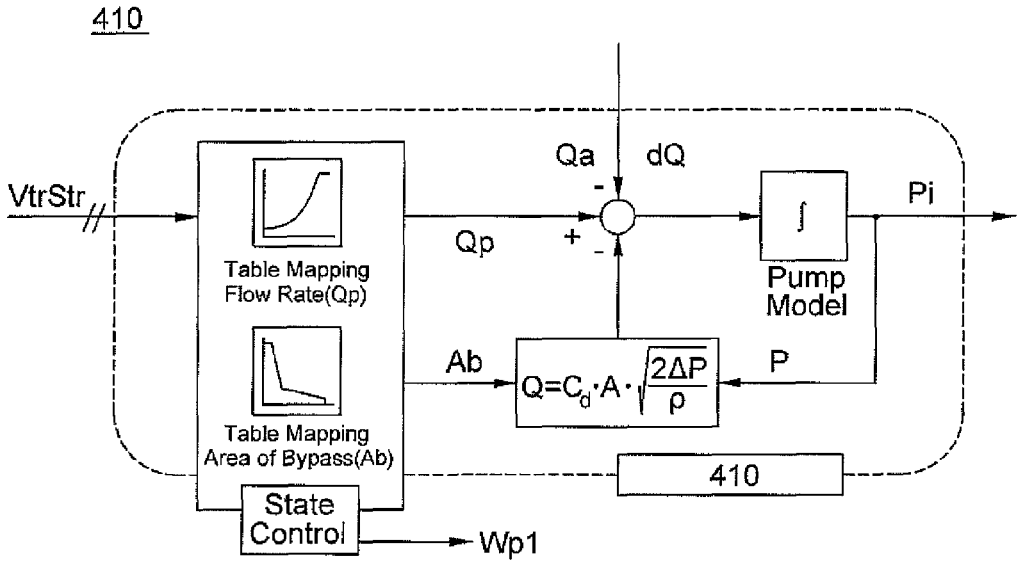
FIG. 8 is a configuration diagram illustrating a flow rate control unit of the hydraulic system for construction equipment according to the exemplary embodiment of the present disclosure.
Figure 9:
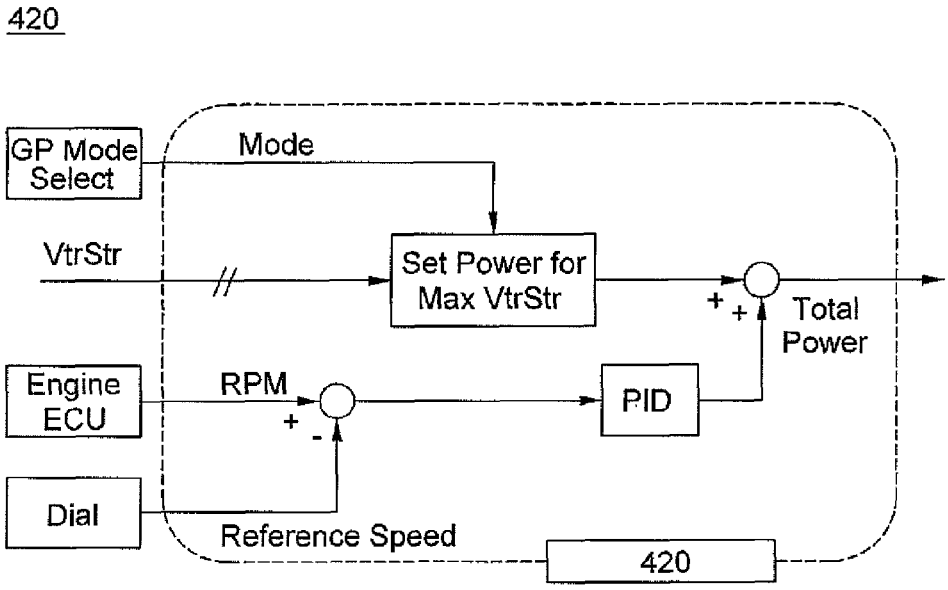
FIG. 9 is a configuration diagram illustrating a power shift controller of the hydraulic system for construction equipment according to the exemplary embodiment of the present disclosure.
Figure 10:
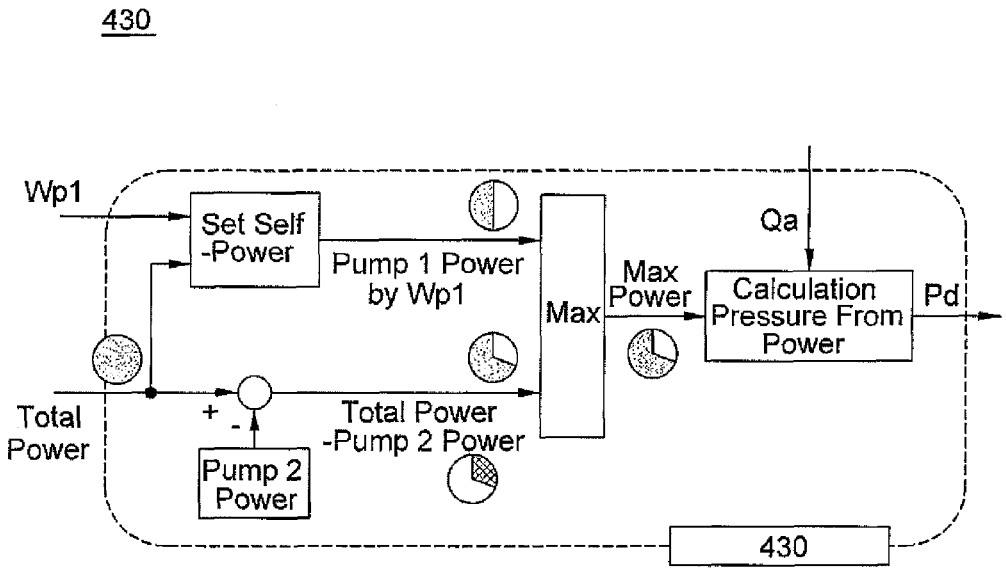
FIG. 10 is a configuration diagram illustrating a horsepower distribution controller of the hydraulic system for construction equipment according to the exemplary embodiment of the present disclosure.

FIG. 6 is a configuration diagram illustrating the hydraulic system for construction equipment according to the exemplary embodiment of the present disclosure, FIG. 7 is a configuration diagram illustrating a controller of the hydraulic system for construction equipment according to the exemplary embodiment of the present disclosure, and FIGS. 8 to 10 are configuration diagrams illustrating a flow rate controller, a power shift controller, and a horsepower distribution controller of the hydraulic system for construction equipment according to the exemplary embodiment of the present disclosure.

Referring to FIGS. 6 and 7, the controller 400 includes a flow rate controller 410, a power shift controller 420, a horsepower distribution controller 430, and a pump controller 440.

The flow rate controller 410 compares flow rates of working oil discharged from the first pump 110 and the second pump 120 with flow rates of working oil required by the plurality of operating units 12, and calculates a torque ratio wp1 provided to each of the first pump 110 and the second pump 120.

Particularly, the flow rate controller 410 receives a swash plate angle from the angle sensor 600 detecting swash plate angles of the first pump 110 and the second pump 120, and calculates a discharged flow rate of the working oil of each of the first pump 110 and the second pump 120.

Further, the operating unit 12 includes the joystick or the pedal as described above, and for example, when the joystick is operated with a maximum displacement, a required signal for a required value (flow rate or pressure) is generated, and the required signal is provided to the flow rate controller 410. The required signal means a size of torque generated by the first pump 110 and the second pump 120.

The flow rate controller 410 calculates a degree of torque to be required in each hydraulic pump 100 by adding or subtracting a flow rate according to the required signal input from the operating unit 12 to or from the flow rates of the working oil currently discharged from the first pump 110 and the second pump 120, and divides the calculated torque by a torque ratio wp1 for the first pump 110 and the second pump 120 each and provides the divided torque to the horsepower distribution controller 430.

In the meantime, a process of calculating a pressure command P, generated by the flow rate controller 410 will be described with reference to FIG. 8. First, the pressure sensor 500 detects pressure of the operating unit 12 and calculates a required flow rate $Q_p$ of each spool configuring the main control valve 300 and a virtual bypass area $A_b$ of the main control valve 300.

Further, the pressure sensor 500 calculates a virtual bypass flow rate $Q_b$ by using the calculated virtual bypass area $A_b$ and a current pressure command P, and subtracts the bypass flow rate $Q_b$ and an actual discharged flow rate $Q_a$, which is calculated by the angle sensor 600, from the required flow rate $Q_p$ to calculate a required increase or decrease flow rate dQ as represented by Equation 1 below.

$$dQ-Q_p-Q_b-Q_a \quad \text{[Equation 1]}$$

When the required increase or decrease flow rate dQ is calculated, the pressure command $P_i$ of each hydraulic pump 100 is calculated from the calculated required increase or decrease flow rate dQ.

Referring back to FIGS. 6 and 7, the power shift controller 420 receives information from the operating unit 12, a load mode selecting unit 14, an engine speed setting unit 16, and an engine control unit (ECU) 18, calculates a total of torque required by the hydraulic pumps 100, and provides the calculated total power to the horsepower distribution controller 430.

Here, the load mode selecting unit 14 select a load mode according to heaviness and lightness of an operation desired to be performed by an operator, and for example, selects a load mode on a dashboard, and may select any one load mode among an excessively heavy load mode, a heavy load mode, a standard load mode, a light load mode, and an idle mode. When a higher load mode is selected, high pressure is formed in working oil discharged from the hydraulic pump 100, and when a lower load mode is selected, a flow rate of working oil discharged from the hydraulic pump 100 is increased.

The engine speed setting unit 16 enables a manager to arbitrarily select an rpm of the engine, and for example, an operator may set a desired engine speed by adjusting an rpm dial. When an engine speed is set to be larger, the engine may provide larger power to the hydraulic pump 100, but there is a concern in that fuel consumption may relatively increase and durability of the construction equipment may deteriorate, so that it is preferable to set an appropriate engine speed. In a case of the standard load mode, an engine speed may be set to about 1,400 rpm, and may also be set to be larger or smaller according to a tendency of an operator.

The engine control unit 18 is a device controlling the engine, and provides information on an actual engine speed to the power shift controller 420.

In the meantime, a process of calculating the total of torque by the power shift controller 420 will be described with reference to FIG. 9. First, the power shift controller 420 calculates power by selecting a maximum value among lever pressure VtrStr of the plurality of operating units 12, performs proportional integral derivative (PID) control by subtracting an engine speed set in the engine speed setting unit 16 from an actual engine speed of the engine control unit 18, and then calculates a total of torque by adding initial power of the engine, the power set by the operating unit 12, and the PID control value.

Referring back to FIGS. 6 and 7, the horsepower distribution controller 430 calculates torque charged by each of the first pump 110 and the second pump 120 according to the torque ratio wp1 calculated by the flow rate controller 410 and the total power of the torque calculate by the power shift controller 420.

A process of calculating a pressure command $P_d$ of each of the hydraulic pumps 100 by the horsepower distribution controller 430 will be described with reference to FIG. 10. First, the horsepower distribution controller 430 divides the total of torque calculated by the power shift controller 420 by the torque ratio wp1 calculated by the flow rate controller 410 and calculates maximum power usable by the first pump 110.

Further, the horsepower distribution controller 430 calculates power of the second pump 120 by using the angle sensor 600 of the second pump 120 and the pressure command, and subtracts the calculated power from the total of torque, and determines a larger value between the maximum power usable by the first pump 110 and the value obtained by subtracting the power of the second pump 120 from the total of torque as maximum power.

The determined maximum power is divided by the actual discharged flow rate $Q_a$ to calculate the pressure command $P_d$ for controlling horsepower.

Referring back to FIGS. 6 and 7, the pump controller 440 selects the smallest value among the pressure command $P_i$ generated by the flow rate controller 410, the pressure command $P_d$ calculated by the horsepower distribution controller 430, and a maximum pump pressure value $P_{max}$ maximally applied to the operating unit 12, outputs the selected smallest value as a pressure command value of the first pump 110 and the second pump 120, converts the pressure command value into a current command, and then transmits the converted current command to the EPPR valve 700.

Figure 11:
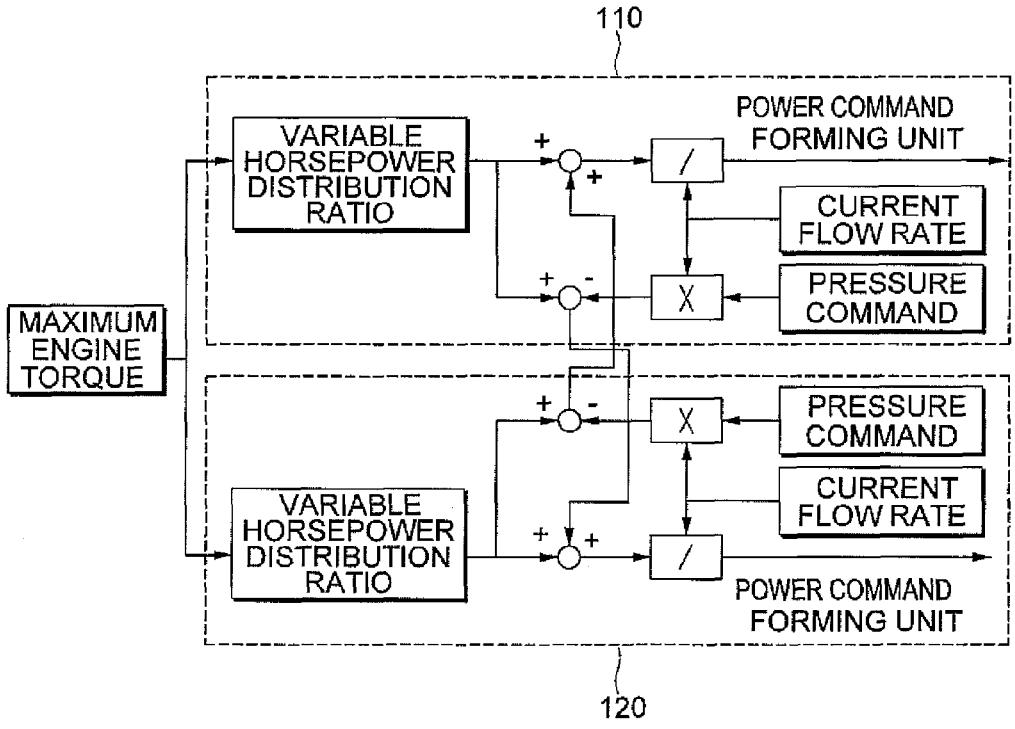
FIG. 11 is a configuration diagram illustrating an example of distribution of horsepower of the engine in the hydraulic system for construction equipment according to the exemplary embodiment of the present disclosure.

FIG. 11 is a configuration diagram illustrating an example of distribution of horsepower of the engine in the hydraulic system of construction equipment according to the exemplary embodiment of the present disclosure, and referring to FIG. 11, engine torque is optimally distributed to a pump, which has larger horsepower consumption because a large load is applied to the pump or an operation quantity thereof is large, by allocating a variable horsepower distribution ratio to each of the first pump 110 and the second pump 120 according to a complex operation mode of the construction equipment.

That is, in order to calculate horsepower currently consumed by the first pump 110 and the second pump 120, a horsepower margin by the amount obtained by subtracting power of the first pump 110 and the second pump 120 calculated by using a current flow rate, which is obtained by the swash plate angle information of the hydraulic pump 100 detected by the angle sensor 600 and the controlling pressure command from the total horsepower, is used.

Figure 12:
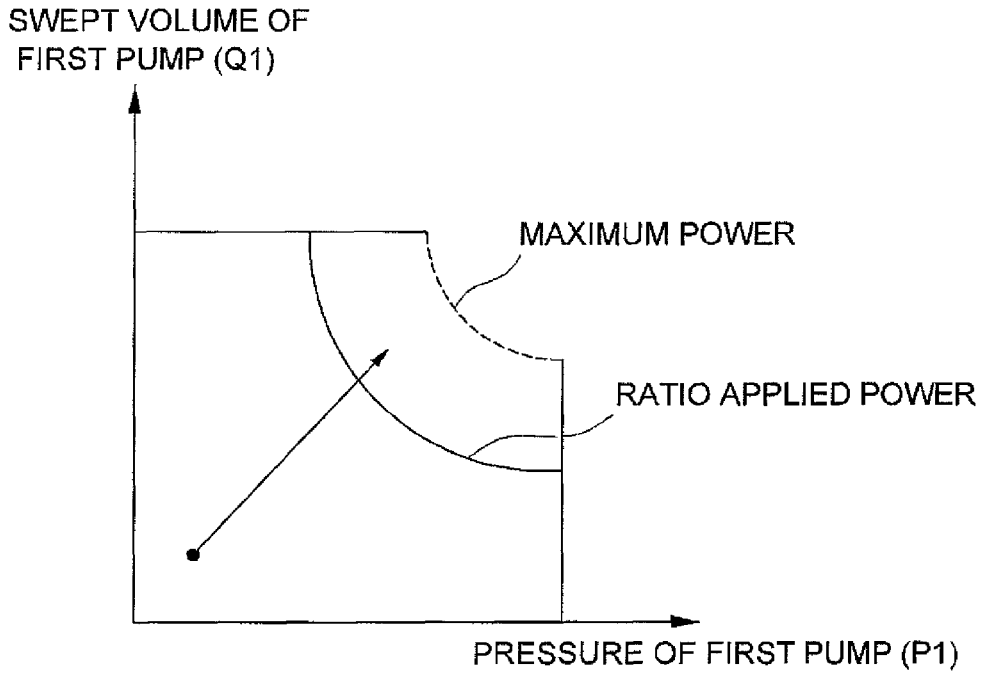
FIGS. 12 to 14 are diagrams illustrating an example, in which power of the engine is distributed to the first pump and the second pump according to a distribution ratio according to FIG. 11.
Figure 13:
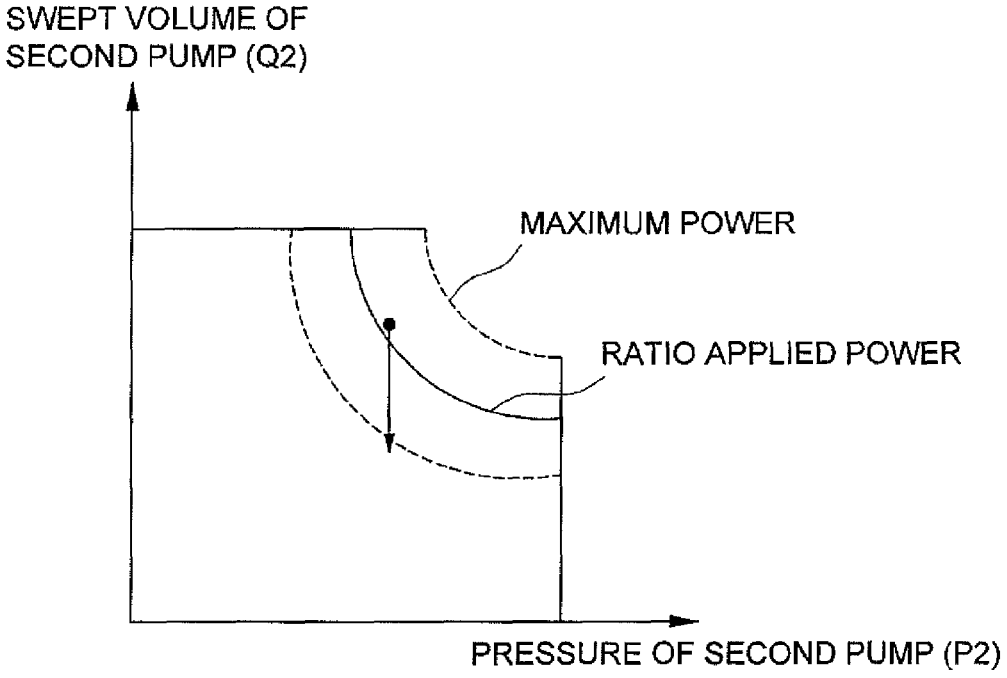
Figure 14:
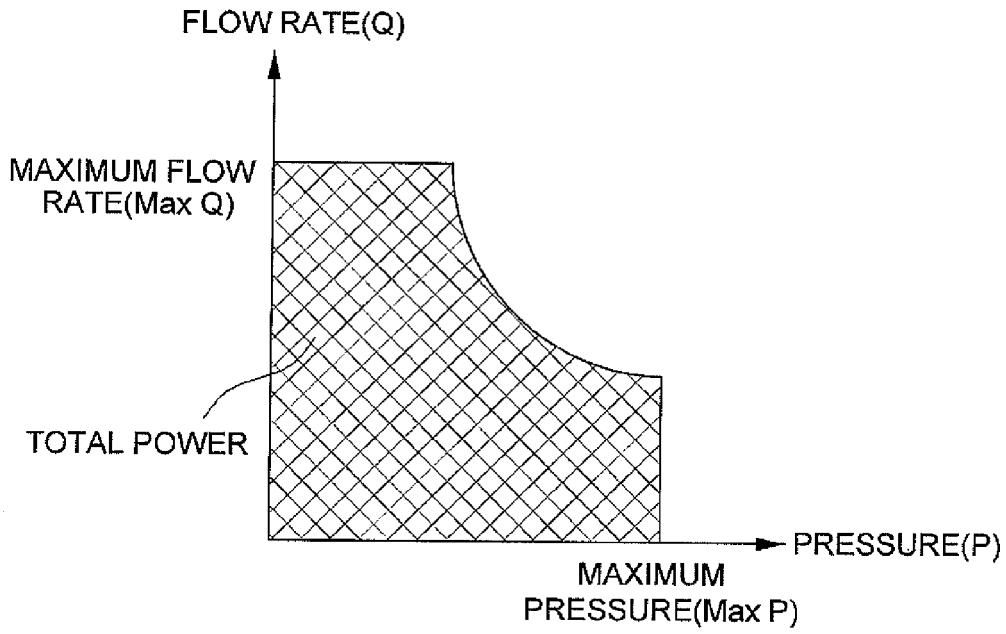

FIGS. 12 to 14 are diagrams illustrating an example, in which power of the engine is distributed to the first pump and the second pump according to a distribution ratio according to FIG. 11, and FIG. 12 is a graph illustrating a power line diagram of the first pump 110.

Pump horsepower (or pump power) is calculated by multiplying the pressure P1 and a flow rate Q1 of the first pump 110, and occupies an area by power obtained by applying a distribution ratio to maximum power (horsepower) in the first pump 110. According to the exemplary embodiment of the present disclosure, when it is assumed that a distribution ratio of the first pump 110 is 70% of the engine horsepower, the pump horsepower occupies a large area corresponding to 70%.

FIG. 13 is a graph illustrating a power line diagram of the second pump 120, and pump horsepower (or pump power) is calculated by multiplying the pressure P2 and a flow rate Q2 of the second pump 120. Similarly, the pump horsepower occupies an area by power obtained by applying a ratio to maximum power (horsepower) in the second pump 120, and according to the exemplary embodiment of the present disclosure, since it is assumed that a distribution ratio of the second pump 120 is 30% of the engine horsepower, the pump horsepower occupies a small area corresponding to 30%.

In FIG. 14, the entire horsepower obtained by adding the pump horsepower (power) of the first pump 110 and the pump horsepower (power) of the second pump 120 is the same as total horsepower (power) provided to the first pump 110 and the second pump 120 by the engine. That is, the pumps use all of the available horsepower, so that there is no energy waste.

Figure 15:
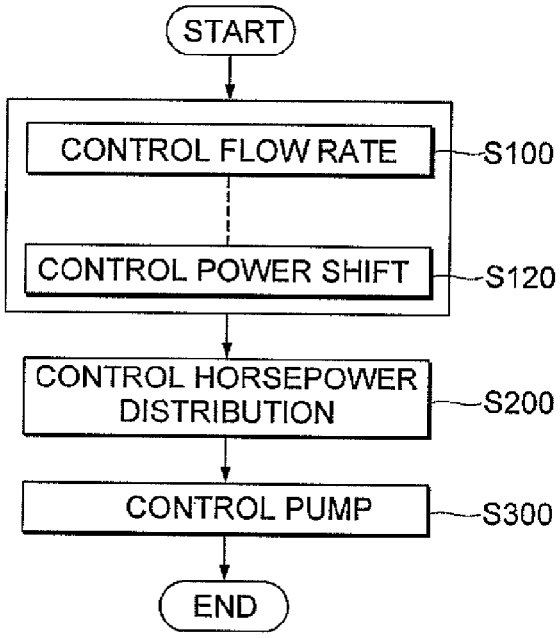
FIG. 15 is a flowchart illustrating a method of controlling the hydraulic system for construction equipment according to an exemplary embodiment of the present disclosure.
Figure 16:
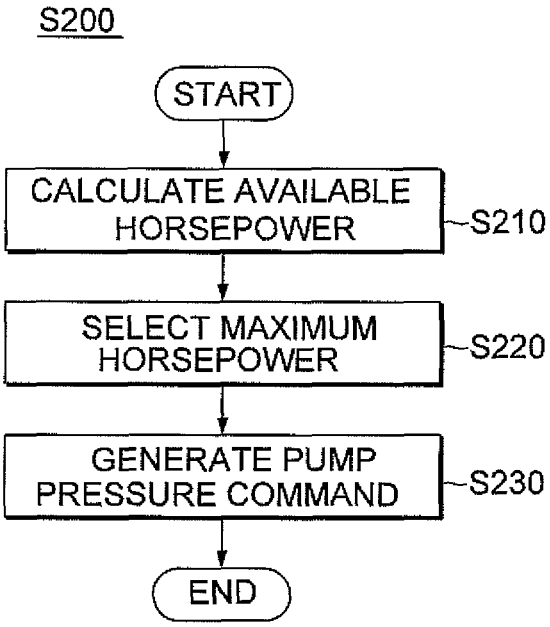
FIG. 16 is a flowchart illustrating an operation of controlling horsepower distribution in the method of controlling a hydraulic system for construction equipment according to the exemplary embodiment of the present disclosure.

FIG. 15 is a flowchart illustrating a method of controlling a hydraulic system for construction equipment according to an exemplary embodiment of the present disclosure, and FIG. 16 is a flowchart illustrating an operation of controlling horsepower distribution in the method of controlling the hydraulic system for construction equipment according to the exemplary embodiment of the present disclosure. A detailed configuration of the method of controlling the hydraulic system for construction equipment will be described in detail with reference to FIGS. 15 and 16. In the meantime, descriptions of the same contents as those of the hydraulic system for construction equipment will be omitted.

Referring to FIG. 15, in the hydraulic system for construction equipment including the plurality of pressure control-type hydraulic pumps 100 driven by the engine, the method of controlling the hydraulic system for construction equipment includes a flow rate control operation S110, a power shift control operation S120, a horsepower distribution control operation S130, and a pump control operation S140.

In the flow rate control operation S110, a flow rate of working oil discharged from the hydraulic pump 100 is compared with a flow rate of working oil required by the plurality of operating units 12 provided in the construction equipment, and a torque ratio wp1 applied to each of the hydraulic pumps 100 is calculated.

The flow rate control operation S110 is performed by the flow rate controller 410, and a detailed control method thereof is the same as the characteristic of the flow rate controller 410 described above.

A process of calculating a pressure command $P_i$ generated in the flow rate control operation S110 is the same as the process of calculating the pressure command $P_i$ generated by the flow rate controller 410 described with reference to FIG. 8, so that a detailed description thereof will be omitted.

In the power shift control operation S120, a total of torque required by the hydraulic pumps 100 is calculated by receiving information from the operating unit 12, the load mode selecting unit 14, the engine speed setting unit 16, and the ECU 18.

The power shift control operation S120 is performed by the power shift controller 420, and a detailed control method thereof is the same as the characteristic of the power shift controller 420 described above.

Further, a process of calculating the total of torque in the power shift control operation S120 is the same as the process of calculating the total of torque by the power shift controller 420 described with reference to FIG. 9, so that a detailed description thereof will be omitted.

In the meantime, the flow rate control operation S110 and the power shift control operation S120 are not restricted to the sequence thereof, and may be simultaneously performed.

In the horsepower distribution control operation S200, torque taken in charge by each hydraulic pump 100 is calculated according to the torque ratio wp1 calculated in the flow rate control operation S110 and the total of torque calculated in the power shift control operation S120.

Particularly, referring to FIG. 16, the horsepower distribution control operation S200 is performed by the horsepower distribution controller 430, and includes an available horsepower calculation operation S210, a maximum horsepower selection operation S220, and a pump pressure command generation operation S230.

In the available horsepower calculation operation S210, an available horsepower value is calculated by subtracting a current horsepower value of a counterpart pump from a maximum horsepower value provided by the engine for each of the hydraulic pumps 100.

In the maximum horsepower selection operation S220, a larger horsepower value between the horsepower value calculated by the torque taken in charge by each hydraulic pump 100 according to the torque ratio wp1 calculated in the flow rate control operation S110 and the total of torque calculated in the power shift control operation S120 and the available horsepower value calculated in the available horsepower calculation operation S210 is selected as a final control horsepower value of a corresponding pump.

In the pump pressure command generation operation S230, the final control horsepower value selected in the maximum horsepower selection operation S220 is generated as a pressure command $P_d$ controlling the corresponding pump.

According to the exemplary embodiment of the present disclosure, the hydraulic pumps 100 include the first pump 110 and the second pump 120, and according to the horsepower distribution control operation S200, a larger horsepower value between the horsepower value calculated by the torque taken in charge by the first pump 110 and a horsepower value obtained by subtracting the horsepower value calculated by the torque taken in charge by the second pump 120 from the maximum horsepower value provided from the engine is selected as a horsepower value of the first pump 110, and the selected horsepower value is generated as a pressure command $P_d$ controlling the first pump 110.

Referring back to FIG. 15, in the pump control operation S300, the smallest value among the pressure command $P_i$ generated by the flow rate control operation S110, the pressure command $P_d$ calculated by the horsepower distribution control operation S130, and the maximum pump pressure value $P_{max}$ maximally applied to the operating unit 12 is selected and output as a pressure command value of the hydraulic pump 100.

The pump control operation S300 is performed by the pump controller 440, and the output pressure command value is converted into a current command and then is transmitted to the EPPR valve 700 to control pressure of the hydraulic pump 100.

The present disclosure has been described with reference to the exemplary embodiments illustrated in the drawings, but the exemplary embodiments are only illustrative, and it would be appreciated by those skilled in the art that various modifications and equivalent exemplary embodiments may be made. Accordingly, the actual scope of the present disclosure must be determined by the appended claims.

What is claimed is:

1. A hydraulic system for construction equipment comprising:

a plurality of pressure control-type hydraulic pumps driven by an engine provided in construction equipment;

an actuator driven by working oil discharged from the plurality of hydraulic pumps;

a closed center-type main control valve provided between the plurality of hydraulic pumps and the actuator; and a controller configured to control the plurality of hydraulic pumps, wherein the controller distributes a maximum horsepower value provided by the engine to each of the plurality of hydraulic pumps according to a distribution ratio preset for each operation mode of the construction equipment, wherein the plurality of hydraulic pumps comprise a first pump and a second pump, and the controller detects operation quantities from the plurality of operating units allocated to the first pump and the second pump, respectively, and sums the detected operation quantity for each of the first pump and the second pump, and allocates the pump having the larger summed operation quantity as the first pump.

2. The hydraulic system of claim 1, further comprising:

a pressure sensor configured to detect pressures of a plurality of operating units provided in the construction equipment;

one or more angle sensor configured to detect a swash plate angle of the plurality of hydraulic pumps; and an electronic proportional pressure reducing (EPPR) valve provided between the plurality of hydraulic pumps and the controller, wherein the controller receives the pressure of the operating unit and the swash plate angle of the plurality of hydraulic pumps and outputs a current command according to the received pressure and swash plate angle to the EPPR valve, and the EPPR valve controls the swash plate angle in order to control the pressure of the plurality of hydraulic pumps so as to be in proportion to the current command.

3. The hydraulic system of claim 1, wherein the controller separately controls the hydraulic pumps according to an operation mode of the construction equipment.

4. The hydraulic system of claim 1, wherein the controller allocates the pump having a larger load pressure between the first pump and the second pump as the first pump.

5. A hydraulic system for construction equipment comprising:

a plurality of pressure control-type hydraulic pumps driven by an engine provided in construction equipment;

an actuator driven by working oil discharged from the plurality of hydraulic pumps;

a closed center-type main control valve provided between the plurality of hydraulic pumps and the actuator; and a controller configured to control the plurality of hydraulic pumps, wherein the plurality of hydraulic pumps comprise a first pump and a second pump, and the controller comprises:

a flow rate controller configured to calculate a torque ratio of the first pump and the second pump;

a power shift controller configured to calculate a total of torque required by the plurality of hydraulic pumps;

a horsepower distribution controller configured to calculate torque taken in charge by the first pump and the second pump according to the torque ratio calculated by the flow rate controller and the total of torque calculated by the power shift controller; and a pump controller configured to select the smallest value among a pressure command generated by the flow rate controller, a pressure command calculated by the horsepower distribution controller, and a maximum pump pressure value maximally applied to the operating unit and output the selected smallest value as a pressure command value of the first pump and the second pump.

6. The hydraulic system of claim 5, wherein the pressure command generated by the flow rate controller is calculated by calculating an increase/decrease required flow rate by subtracting a flow rate of working oil discharged from the plurality of hydraulic pumps from a required flow rate calculated by detecting an operation pressure of the operating unit.

7. The hydraulic system of claim 5, wherein the pressure command calculated by the horsepower distribution controller is calculated by determining a larger value between maximum power usable by the first pump calculated by dividing the total of torque calculated by the power shift controller by the torque ratio calculated by the flow rate controller and a value obtained by calculating power of the second pump by using an angle sensor and a pressure command of the second pump and subtracting the calculated power of the second pump from the total of torque as maximum power, and dividing the determined maximum power by an actual discharged flow rate.

8. The hydraulic system of claim 5, wherein the controller distributes a maximum horsepower value provided by the engine to each of the hydraulic pumps according to a distribution ratio preset for each operation mode of the construction equipment, and wherein the controller detects operation quantities from the plurality of operating units allocated to the first pump and the second pump, respectively, and sums the detected operation quantity for each of the first pump and the second pump, and allocates the pump having the larger summed operation quantity as the first pump.

9. The hydraulic system of claim 5, wherein the controller distributes a maximum horsepower value provided by the engine to each of the hydraulic pumps according to a distribution ratio preset for each operation mode of the construction equipment, and wherein the controller allocates the pump having a larger load pressure between the first pump and the second pump as the first pump.

10. A method of controlling a hydraulic system for construction equipment comprising a plurality of pressure control-type hydraulic pumps driven by an engine provided in construction equipment, the method comprising:

calculating a torque ratio of the plurality of hydraulic pumps;

calculating a total of torque required by the plurality of hydraulic pumps;

a horsepower distribution control operation for calculating torque taken in charge by each of the plurality of hydraulic pumps according to the torque ratio and the total of torque; and a pump control operation for selecting a smallest value among a pressure command generated in the flow rate control operation, a pressure command calculated in the horsepower distribution control operation, and a maximum pump pressure value maximally applied to the operating unit and outputting the selected smallest value as a pressure command value of the plurality of hydraulic pumps.

11. The method of claim 10, wherein the pressure command generated in the flow rate control operation is calculated by calculating an increase/decrease required flow rate by subtracting a flow rate of working oil discharged from the plurality of hydraulic pumps from a required flow rate calculated by detecting an operation pressure of the operating unit.

12. The method of claim 10, wherein the pressure command calculated in the horsepower distribution control operation is calculated by determining a larger value between maximum power usable by any one of the hydraulic pumps calculated by dividing the total of torque calculated by the power shift control operation by the torque ratio calculated by the flow rate control operation and a value obtained by calculating power of the other of the hydraulic pumps by using an angle sensor and a pressure command of the other of the hydraulic pumps and subtracting the calculated power of the other of the hydraulic pumps from the total of torque as maximum power, and dividing the determined maximum power by an actual discharged flow rate.

13. The method of claim 10, wherein the horsepower distribution control operation comprises:

an available horsepower calculation operation for calculating an available horsepower value by subtracting a current horsepower value from a counterpart pump from a maximum horsepower value provided by the engine for each of the plurality of hydraulic pumps;

a maximum horsepower selection operation for selecting a larger horsepower value between a horsepower value calculated by the torque taken in charge by each of the plurality of hydraulic pumps according to the torque ratio calculated in the flow rate control operation and the total of torque calculated in the power shift control operation and the available horsepower value calculated in the available horsepower calculation operation as a final control horsepower value of a corresponding pump; and a pump pressure command generation operation for generating the final control horsepower value selected in the final horsepower selection operation as a pressure command controlling the corresponding pump.

14. The method of claim 13, wherein the plurality of hydraulic pumps are separately controlled according to an operation mode of the construction equipment.

15. The method of claim 13, wherein a maximum horsepower value provided by the engine is distributed to each of the plurality of hydraulic pumps according to a distribution ratio preset for each operation mode of the construction equipment.

16. The method of claim 10, wherein the plurality of hydraulic pumps comprise a first pump and a second pump, and the horsepower distribution control operation comprises:

selecting a larger horsepower value between a horsepower value calculated by the torque taken in charge by the first pump and a horsepower value calculated by subtracting a horsepower value calculated by the torque taken in charge by the second pump from a maximum horsepower value provided by the engine as a horsepower value of the first pump, and generating the selected horsepower value as the pressure command controlling the first pump.

17. The method of claim 16, wherein operation quantities are detected from the plurality of operating units allocated to the first pump and the second pump, respectively, and the detected operation quantity is summed for each of the first pump and the second pump, and the pump having the larger summed operation quantity is allocated as the first pump.

18. The method of claim 16, wherein the pump having a larger load pressure between the first pump and the second pump is allocated as the first pump.

* * * * *